United States Patent [19]

Smith

[11] 4,069,690

[45] Jan. 24, 1978

[54] KNITTING APPARATUS

[75] Inventor: Donald Smith, Ilkley, England

[73] Assignee: I.W.S. Nominee Company Limited, London, England

[21] Appl. No.: 700,053

[22] Filed: June 25, 1976

[30] Foreign Application Priority Data

June 30, 1975 United Kingdom ..... 27580/75

[51] Int. Cl.[2] ..... D04B 9/32; D04B 15/60

[52] U.S. Cl. ..... 66/135; 66/82 R; 66/136; 66/213

[58] Field of Search ..... 66/180, 128, 129, 135, 66/136, 146, 209, 213

[56] References Cited

U.S. PATENT DOCUMENTS

| | | | |
|---|---|---|---|
| 768,093 | 8/1904 | Thierfelder | 66/135 |
| 1,008,752 | 11/1911 | Stoehrel | 66/135 |
| 1,355,196 | 10/1920 | Walter | 66/135 UX |
| 1,581,977 | 4/1926 | Nebel | 66/135 |
| 1,978,412 | 10/1934 | Carlson | 66/135 |
| 2,327,747 | 8/1943 | Sirmay | 66/146 X |
| 2,615,319 | 10/1952 | Levin | 66/135 |

FOREIGN PATENT DOCUMENTS

| | | | |
|---|---|---|---|
| 15,420 of | 1910 | United Kingdom | 66/135 |

*Primary Examiner*—Ronald Feldbaum
*Attorney, Agent, or Firm*—Harold L. Stowell

[57] ABSTRACT

Decorative knitted fabrics have a basic weft knit structure with patterned effects produced by a warp yarn loops of which cover selected loops of weft yarn so as to be visible on the face of the fabric. The fabrics are produced by feeding warp yarns to selected needles of a straight bar knitting machine in addition to the normal weft yarn and controlling the tension of the yarn such that the warp yarn loops cover the corresponding weft yarn loops in the desired manner. To ensure the desired structure, it is preferred that the tension in the warp yarn should be relatively high when the yarn is wrapped round the selected needles but relatively low when the needles execute their knitting motion. Apparatus for producing these fabrics includes warp yarn guides which can be moved to and fro in front and behind the knitting needles and moved sideways past one or more needle positions. The warp guides can be swung upwards to clear the needles during fashioning movements. Warp tensioning means including a brake on the warp supply spool and a pair of cooperating bars or wires, moved in timed relationship with the knitting cycle, ensure that the correct tension sequence is observed.

4 Claims, 13 Drawing Figures

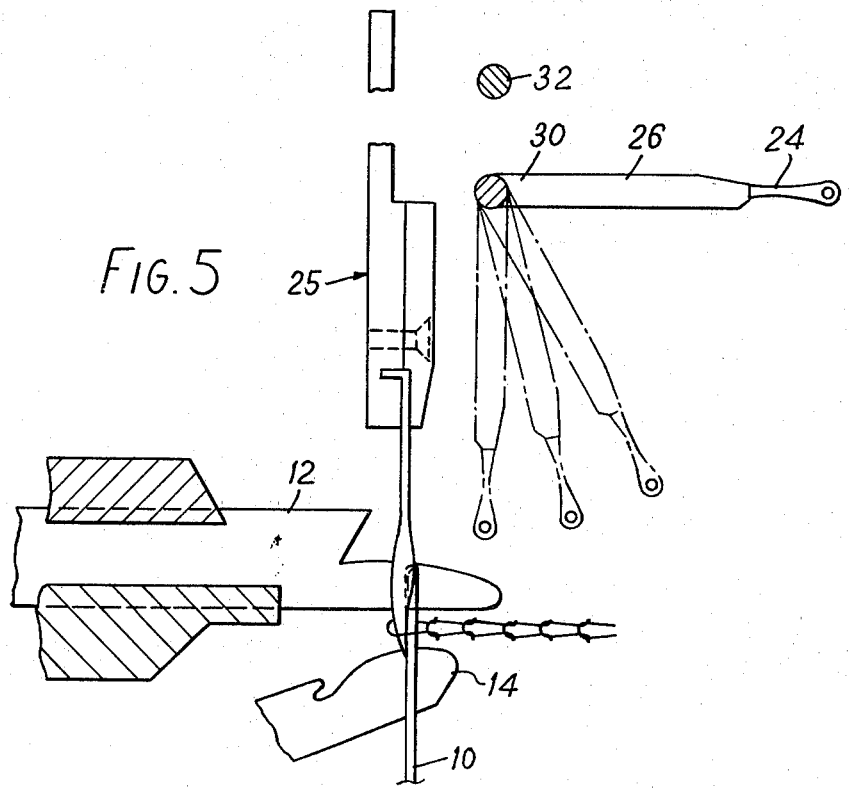
FIG. 5
FIG. 6
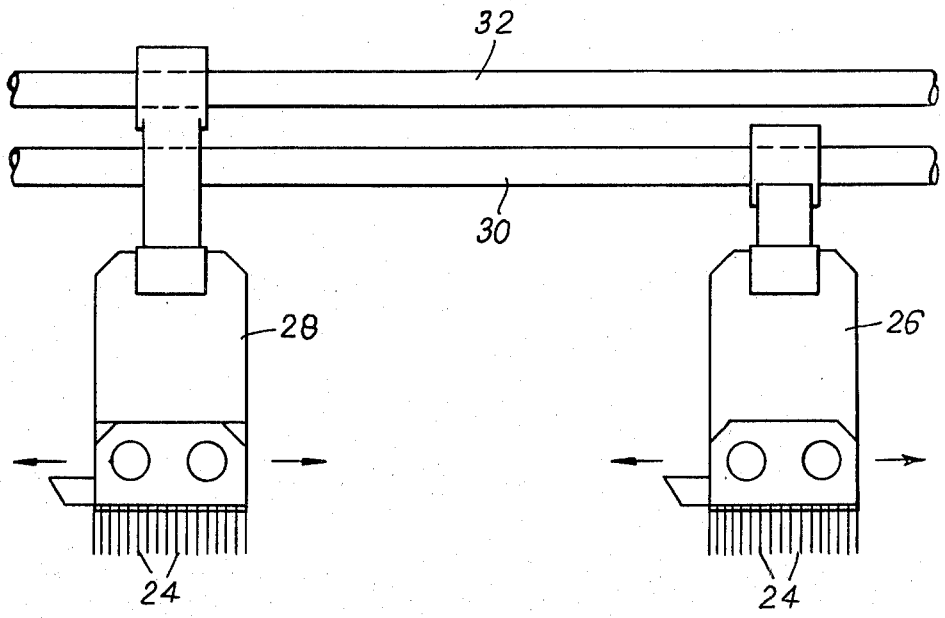

KNITTING APPARATUS

This invention relates to a method of knitting patterned fabrics on a weft-knitting machine, and to an improved machine for this purpose.

Straight-bar fully-fashioned knitting machines (also known as "Cottons Patent") are widely used to produce fully-fashioned single jersey fabrics for end-uses such as sweaters. It has always been possible to pattern these fabrics in the weft direction although anything more complicated than simple courses of different colours has entailed floating stitches in the reverse face of the fabric. Such floating lengths of yarn are undesirable as they are easily snagged, damaging the fabric.

Producing patterns in the warp direction has hitherto been impractical because the normal yarn is laid in the weft direction. This is a serious disadvantage as there is a demand for fabrics, for sweaters in particular, with vertical rather than horizontal designs.

The present invention seeks to overcome these patterning limitations of straight-bar machines by superimposing a warp knitting facility on the basic weft-knitting system.

In its broadest aspect the invention provides a method of forming a weft-knit fabric with a pattern in the warp direction which comprises feeding warp yarns to selected needles of the knitting machine in addition to the normal weft yarn and controlling the tension of the yarn such that the warp yarn loops cover the corresponding weft yarn loops and are preferentially visible at the face of the fabric.

A separate end of warp yarn is fed to each needle selected, and therefore each warp yarn may be of any desired colour, or otherwise differentiated from the weft yarn, to provide a patterning effect. The warp yarn fed to any particular needle will be knit into a wale which will cover or "plate" the corresponding wale of weft fed yarn, and therefore show on the surface of the fabric in the warp direction.

The present invention also provides an apparatus which comprises a straight-bar knitting machine having auxiliary feeders to supply ends of warp yarn to selected needles and tensioning means operable in timed relationship with the knitting cycle to ensure that the warp yarn is supplied at the desired tension. The auxiliary feeders may be similar to the yarn guides employed in warp knitting machines.

In fully-fashioned machines, during the fashioning motion, provision is made for the auxiliary feeders to move to a position in which they do not interfere with the fashioning movement. The tensioning means is capable of maintaining the desired warp yarn tension throughout this movement.

The present invention also provides a weft-knitted fabric having warp knitted loops plated over the weft-knit structure in selected wales to confer a decorative effect visible at the face of the fabric.

The warp loops may be plated over the weft loops in individual selected wales, giving a warp-direction effect stripe in the fabric or, by sideways movement of the warp yarn feeders, in groups of adjoining wales, or in combinations of single and groups of wales, whereby fabrics with zig-zag, diamond-shaped or striped patterns can be produced.

The invention will be described further, by way of example, with reference to the accompanying drawings, in which:

FIGS. 1 to 5 are diagrammatic sectional views through a straight-bar fully-fashioned knitting machine modified in accordance with the invention at different stages of the knitting cycle;

FIG. 6 is a view of two independent banks of auxiliary feeders on a machine according to the invention;

Figure 1:
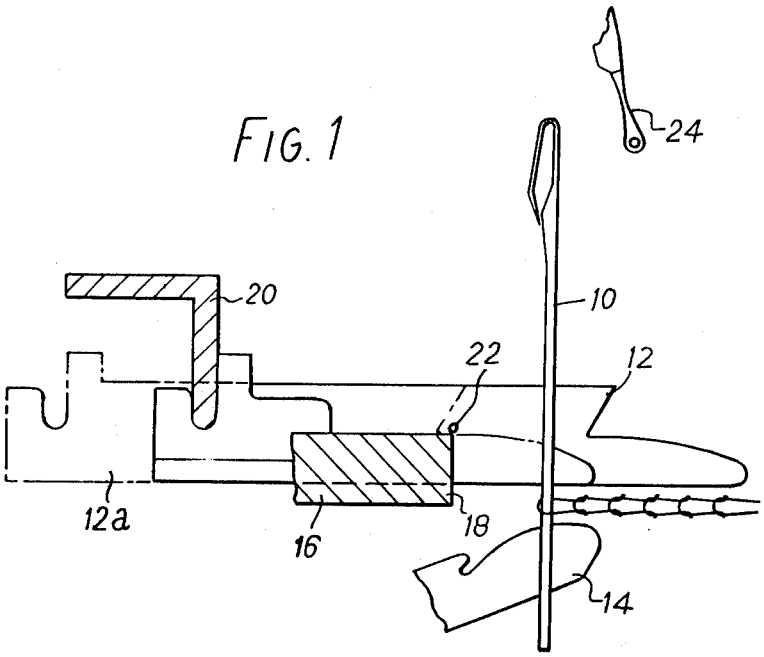
Figure 2:
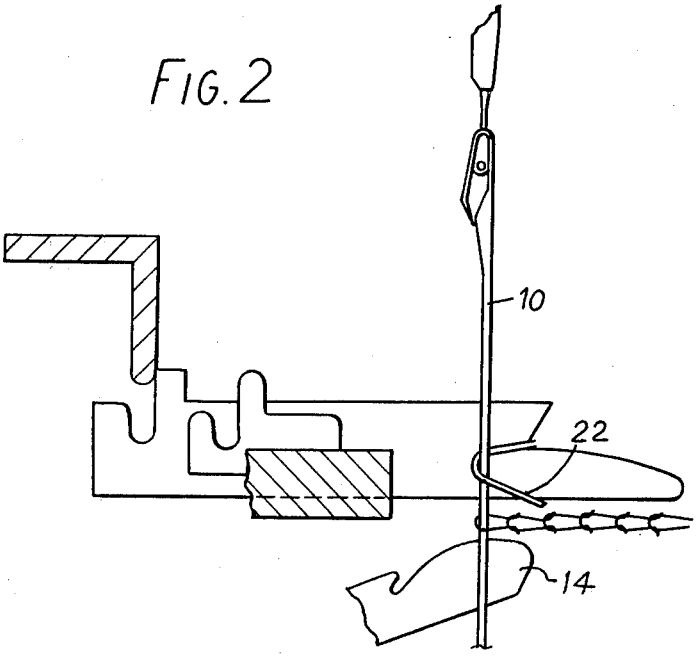
Figure 3:
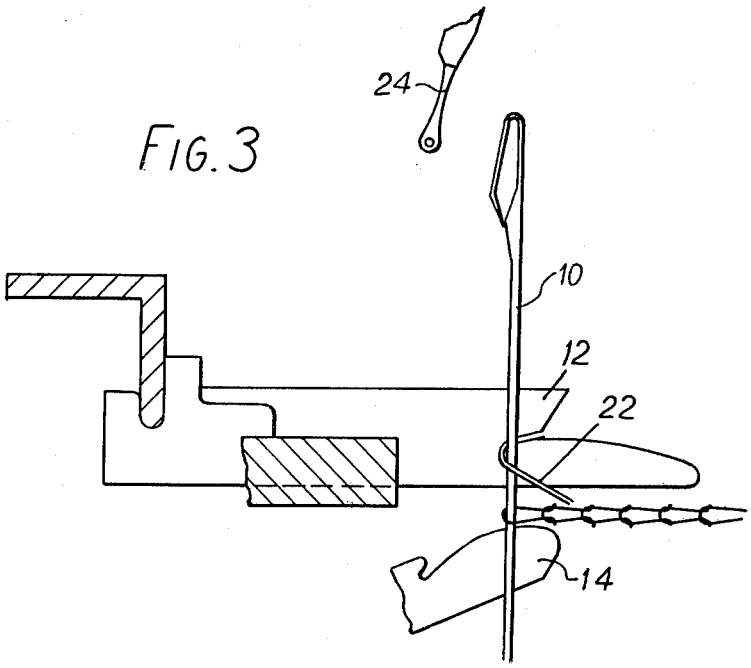
Figure 3:
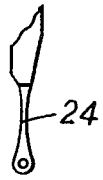
Figure 4:
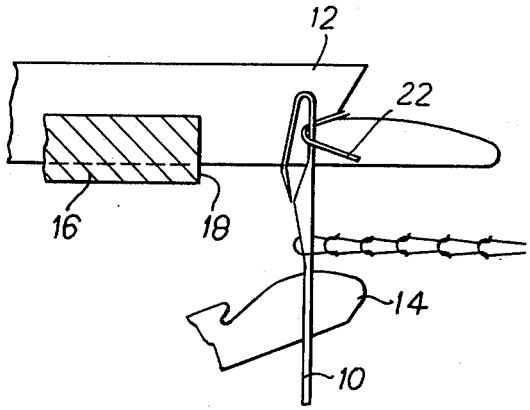

In order more fully to understand the invention it is helpful first to consider the normal knitting cycle without reference to addition of warp yarn. In FIGS. 1 to 5 a section of a conventional straight-bar machine is shown, illustrating a single beard needle 10 of a needle bed and its associated sinker 12 and knock-over 14. The sinker 12 slides in a sinker bar 16 the front end 18 of which functions as a presser nose. A catch bar 20 is engageable with the sinker 12 to move it backwards (toward the left in the Figures) at the appropriate time in the knitting cycle.

The knitting sequence is as follows. A weft yarn feeder (not shown) moves along the needle bed laying a yarn 22 behind each needle 10 in the throat of each sinker 12. At this point each needle 10 is at the position shown in FIG. 1 and each sinker has been drawn back by the catchbar 20 to the position shown in chain-dotted line at **12*a* in FIG. 1. The catchbar 20 disengages and moves to its forward position ready to begin another cycle. Following the yarn feeder, a slurcock cam (again not shown) moves along the machine and pushes out each sinker 12 to the position shown in FIG. 2, looping the yarn 22 round the shank of the needle 10. The needles 10 then drop en masse and move backwards to the position of FIG. 4 catching the loops of yarn 22 in the beards. As the downward and backward motion continues, the beards butt against the presser nose 18, whereby the beards are closed to allow the previously formed loops to pass over them when the associated knock-overs 14 rise to cast off the loops. The needles 10 then move forward and upward to the position of FIG. 1** allowing the loops held in the beards to pass down onto the shanks of the needles ready for the next cycle. The cycle of operating is then repeated, with the yarn being fed from the opposite side of the machine.

FIG. 5 shows part of a conventional fashioning operation. When it is desired to increase or decrease the width of the fabric being knitted, a pair of fashioning blocks 25 descend in the known manner and engage the selvedge loops at each side of the knitted fabric. The fashioning points of the blocks then lift these loops off their needles and onto the next adjacent needles, in or out as selected. The knitting cycle then continues as before over the new width of fabric.

To perform the method of the invention, auxiliary feeders 24 are provided in association with selected needles 10. The feeders 24 are held in one of two thread guide blocks 26, 28 each mounted on a respective thread guide bar 30, 32 (FIG. 6). These bars 30, 32 are the conventional lacing bars available on straight-bar machines, modified as described more fully hereinafter. Referring again to FIGS. 1 to 4 it can be seen that each auxiliary feeder 24 executes an "underlap" motion by moving backwards during the knitting cycle past the needle 10 and then forward again, while at the same time being racked sideways one or more needle positions, as selected, by movement of the guide bars 30, 32 and may be moved back again at the end of the knitting cycle. These combined movements wrap a loop of warp yarn 34 (omitted from FIGS. 1 to 4 for clarity) about the shank of the needle 10. This loop is then knitted into the fabric along with the loop of weft yarn 22 already on the needle 10. As the warp yarn is applied to the needle after the weft yarn it appears on the surface of the fabric covering the weft yarn loop.

The thread guide blocks 26, 28 can each, independently, be progressively racked sideways to give a diagonal line in the finished fabric rather than a vertical line. Similarly, the racking can be altered to give, for example, diamond shapes or zig-zag lines. Sideways movement of the guide blocks between knitting courses, to resituate the warp guides for the subsequent course, is carried out with the guides 24 in front of the needles and may be termed an "overlap" motion.

Figure 9:
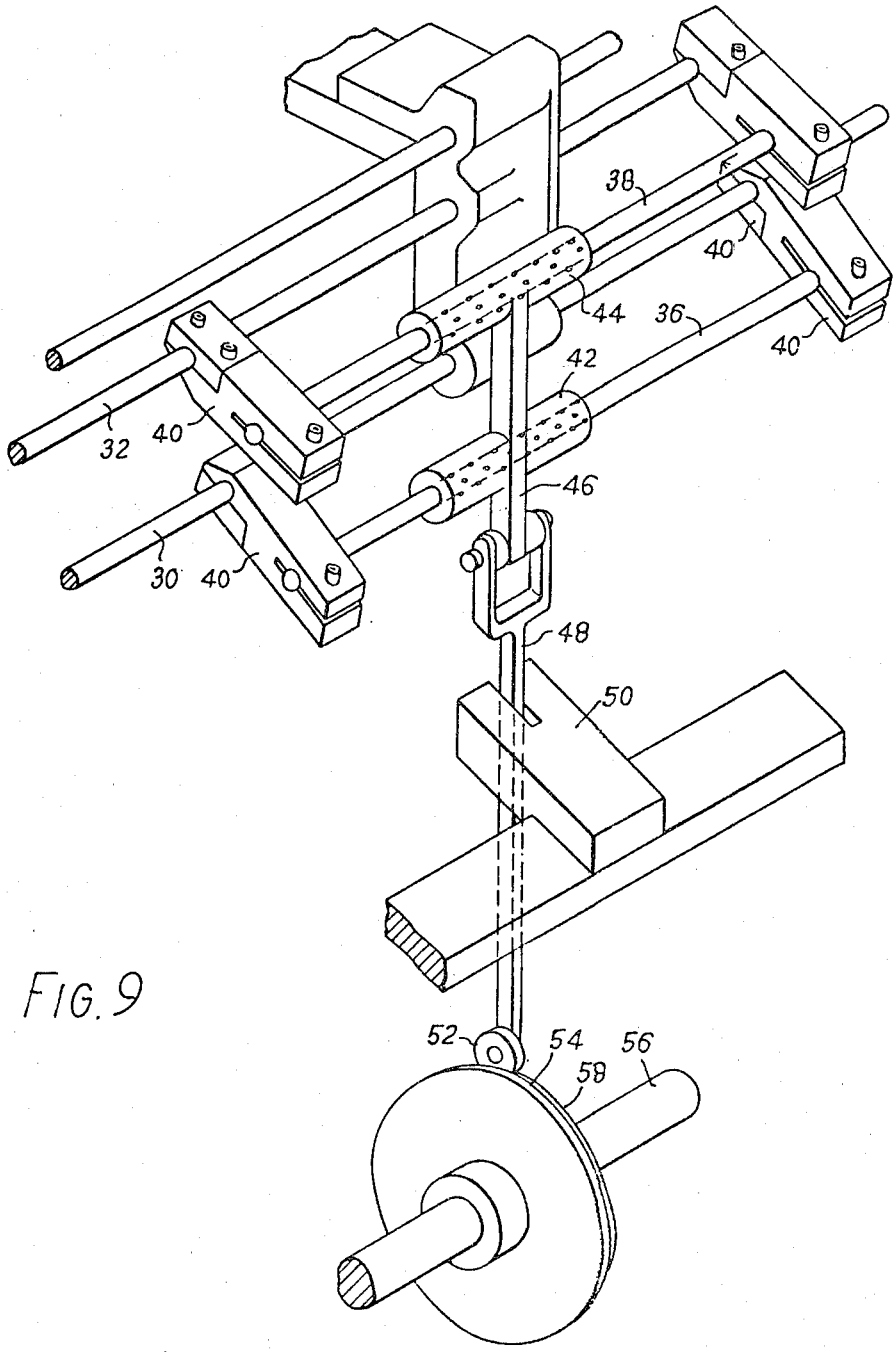
FIG. 9 is a partial perspective view of the auxiliary feeder drive mechanism.

The motion of the thread guide blocks 26, 28 is produced as follows. The sideways racking facility is already present as the guide bars 30, 32 are the conventional lacing bars available on this type of machine. However the mechanism is altered so that the bars can rack sideways on each knitting cycle rather than just on fashioning motions as in conventional machines. The swinging motion of the guide bars is obtained by the mechanism illustrated in FIG. 9. Two auxiliary rods 36, 38 are clamped to the bars 30, 32 by means of clamps 40. Two needle roller bearings 42, 44 are rigidly mounted on a rod 46 and are slidably disposed about rods 36, 38. The rod 46 is connected to a push rod 48 which passes through a guide block 50 and carries a cam-follower 52 at its extremity. The cam follower 52 rests on a cam 54 fixed to the main camshaft 56 of the machine. The cam is profiled to cause the guide bars 30, 32 to swing through approximately 50° clockwise and back again during each knitting cycle. This is sufficient to move the guide blocks 26, 28, and thus the feeders 24, from the position of FIG. 1 to that of FIG. 3 and back again. The cam profile also allows dwell periods of approximately one-quarter cycle at the positions of FIG. 1 and FIG. 3.

In order to ensure that the needles 10 are not damaged by the feeders 24 or guide blocks 26, 28 during the fashioning motion, the latter are swung up to the position shown in FIG. 5 during each fashioning operation. This is achieved by shifting the swing mechanism cam follower 52 from the knitting cycle cam 54 to a fashioning cycle cam 58 located adjacent to the cam 54. The cam 58 is profiled to swing the guide bars 30, 32, and thus the blocks 26, 28, to the position shown in FIG. 5 and hold them there until the fashioning operation is over. After this the blocks swing back into the position of FIG. 1 and the follower 52 is switched back to the cam 54.

The tension of the warp yarn is critical for producing fabrics of acceptable aesthetic appearance. As is apparent from the above, the feeders 24 move considerably during the knitting and fashioning cycles and thus it is necessary to provide a mechanism which controls the warp yarn tension in timed relation with the movements of the feeders 24. If the tension is not properly controlled, the size and tension of the warp loops knitted will not be even and predictable and the underlying weft loops may show through on the surface of the fabric, spoiling its appearance.

Figure 7:
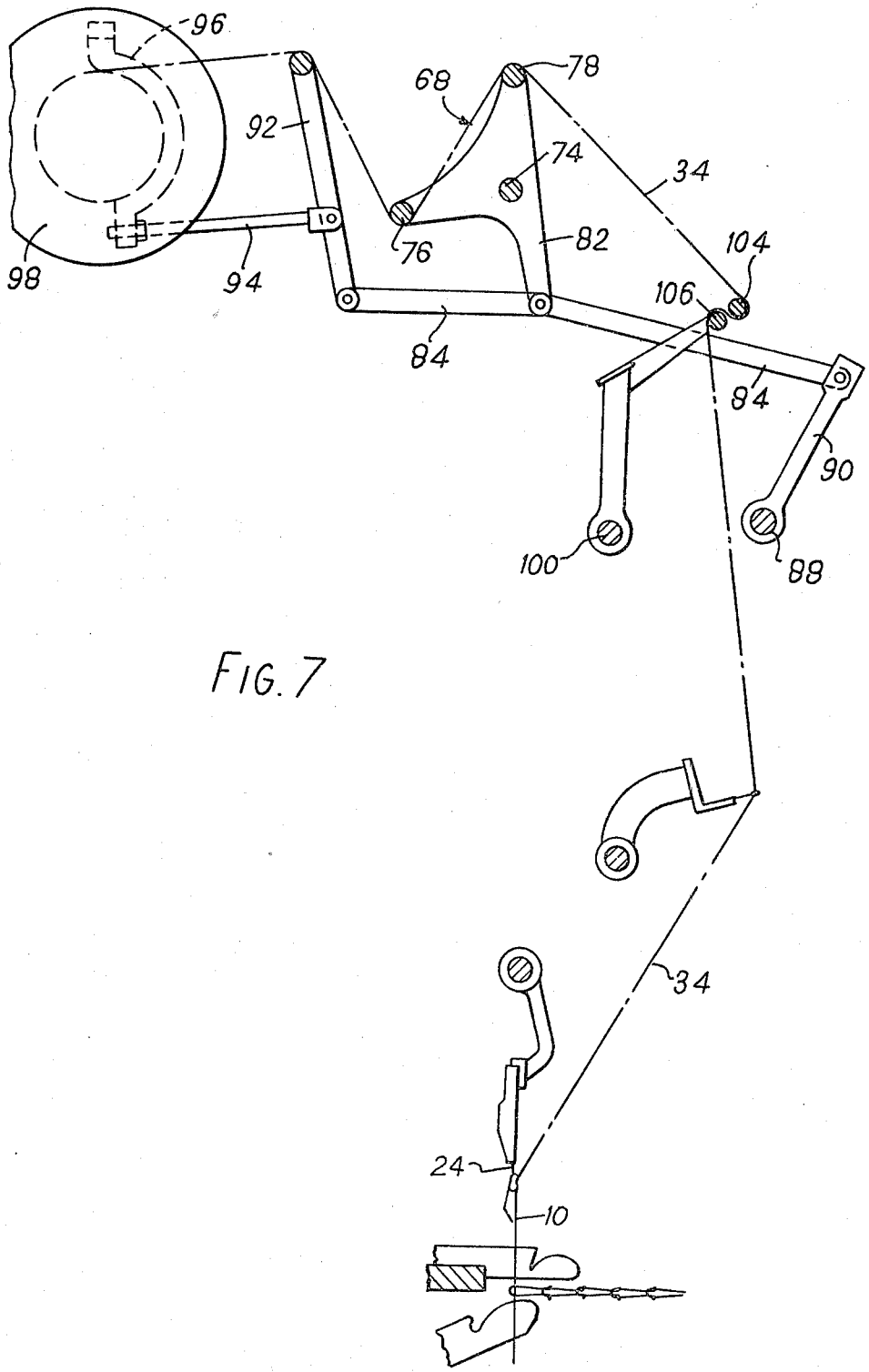
FIG. 7 is a partial diagrammatic sectional view of the machine of FIG. 1 showing the warp yarn feed and tensioning system.
Figure 8:
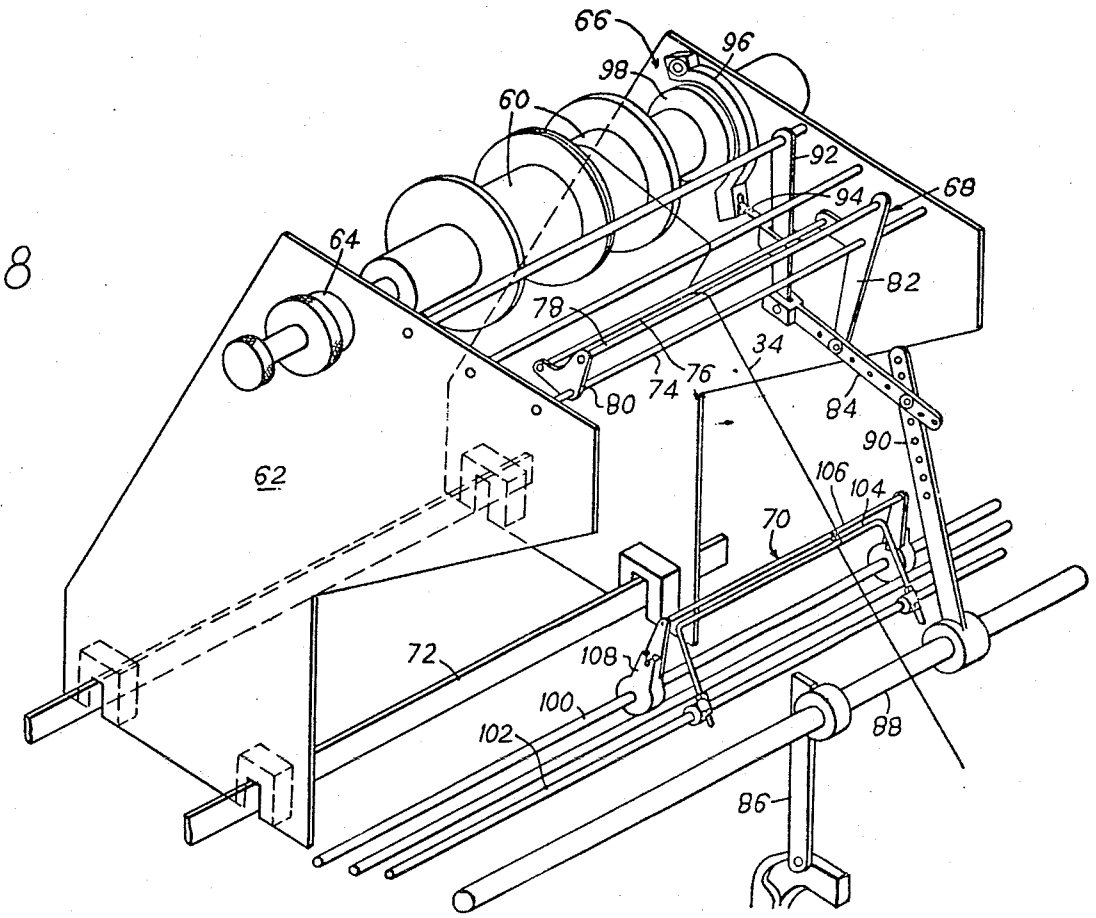
FIG. 8 is a partial perspective view of the warp yarn feed and tensioning system of FIG. 7.

FIGS. 7 and 8 illustrate the novel warp yarn feed and tensioning mechanism employed in this embodiment of the apparatus of the invention. The desired number of ends of warp yarn 34 are wound on a drum 60 rotatably mounted in a frame 62 by means of bearings 64. The rotation of the drum 60 is controlled by a brake mechanism 66, and a yarn reservoir assembly 68 holds a short reserve of yarn. The yarn is taken from the drum by a tensioning arrangement 70.

The frame 62 carries the whole feed and tensioning mechanism and is mounted on top of the machine, on bars 72 which form part of the frame of the basic machine.

The yarn reservoir assembly 68 comprises three rods 74, 76, 78 mounted in end plates 80, 82. The rod 74 is pivotally mounted in the frame 62. The plate 82 is elongated and is pivotally attached to a link rod 84 which is part of a mechanism actuated by the fashioning motion of the basic machine. When the machine performs a fashioning step a bar 86, attached to the main fashioning frame of the basic machine, effects rotation of a shaft 88 on which is mounted a bar 90, which is thus swung anti-clockwise (as viewed in FIG. 8). The bar 90 is pivotally attached to the rod 84 which in turn is pivotally attached to a lever 92 pivoted to the frame 62. A spring-loaded push rod 94 is connected between the lever 92 and a brake collar 96 adapted to bear on a brake drum 98 on the yarn drum 60. These latter components form the brake mechanism 66.

Thus it can be seen that, on actuation of the fashioning frame of the basic machine, the yarn reservoir assembly 68 pivots clockwise (as seen in FIG. 8) and allows the yarn 34 a clear path, while the brake mechanism 66 is applied to the drum 60 causing it to cease rotation. During this movement the yarn stored in the reservoir assembly 68 is released and is available to be drawn forward by the auxiliary feeders 24 as they move out to the fashioning position (FIG. 5). As the fashioning motion draws to a close and the feeders 24 swing back to the knitting position, the reservoir assembly 68 returns to the position shown in FIGS. 7 and 8, thus taking up the slack yarn.

The machine of this invention has a pair of tensioning bars 104, 106 mounted on the movement bars 100, 102. The yarns 34 are wrapped over the bar 104 and under the bar 106 forming small laps of yarn. The timing of the motion of the movement bar 102 is such that the bar 106 is in the position shown in FIG. 8 during most of the knitting cycle. However, when the needles 10 begin their downward movement the bar 106 moves clockwise, freeing the lap of yarn 34 to enable a loop of warp yarn 34 to be knitted. The bar 106 is provided with adjusters 108 to enable the size of the lap to be adjusted to give the desired loop size and tension. When the bar returns to the position shown in FIG. 8, it pulls some more yarn 34 from the drum 60 ready for the next knitting cycle. A basic tension is applied to the warp yarn drawn from the drum by a partial application of the brake 66.

Hence it can be seen that the tension and feed of the warp yarn 34 is controlled in timed relationship with the normal weft knitting cycle to allow the warp yarn 34 to be plated accurately over the weft loops in selected positions, and to ensure that the yarn tension is correct before, during, and after fashioning movements.

As already mentioned, stitch length and yarn tension are critical if a commercially acceptable fabric is to be produced. The stitch length of the basic weft fabric is controlled by mechanical adjustment of the needle and sinker movements, but the stitch length of the warp yarn loops is controlled by the novel yarn feed and tensioning mechanism of this invention. In particular, the tensioning bars 104, 106 should be adjusted to pull the amount of warp yarn 34 from the drum 60 appropriate to the desired stitch length. The operation of the device is such that the warp thread is held reasonably taut as the warp yarn feeders 24 wrap it around the needles, for example at a tension in the range 12 to 14 grams, but as the needles descend in the knitting cycle, the tensioning bars release the loop of yarn to allow the tension to drop to a low fringe. One to five grams tension is a typical range at this stage.

However, if it is desired to produce a diagonal or zig-zag pattern, the warp feeders 24 in their underlap movement will shog across one or more needles between courses and thus warp yarn will lie in sinkers between certain of the selected needles. In this case, the operation of the sinkers will determine the stitch lengths of the warp loops and it is desirable to maintain the warp yarn under some tension during knitting. To achieve this, the tensioning bar 104 has spring-loaded hinges and can be snapped back out of the path of the yarn 34, whose tension is then controlled by the partial application of the brake 66 on the shaft of the warp yarn drum. This also ensures, although in a somewhat different manner, that the warp yarn tension is higher when the yarn is being laid in the needles than when the needles are executing their knitting motion. If, in the absence of the special measures of this invention, the tension is reversed, the warp yarn will not plate the weft and the desired fabric will not be obtained.

FIGS. 10 to 13 show portions of fully-fashioned knitted panels, comprising weft knitted ground fabrics surmounted by warp knitted patterns. For the purpose of illustrating the formation of the weft and warp knitted loops, the warp loops are reduced to thin complete, chain-dotted or broken lines. In an actual fabric, the warp loops would completely cover the weft knitted loops.

Figure 10:
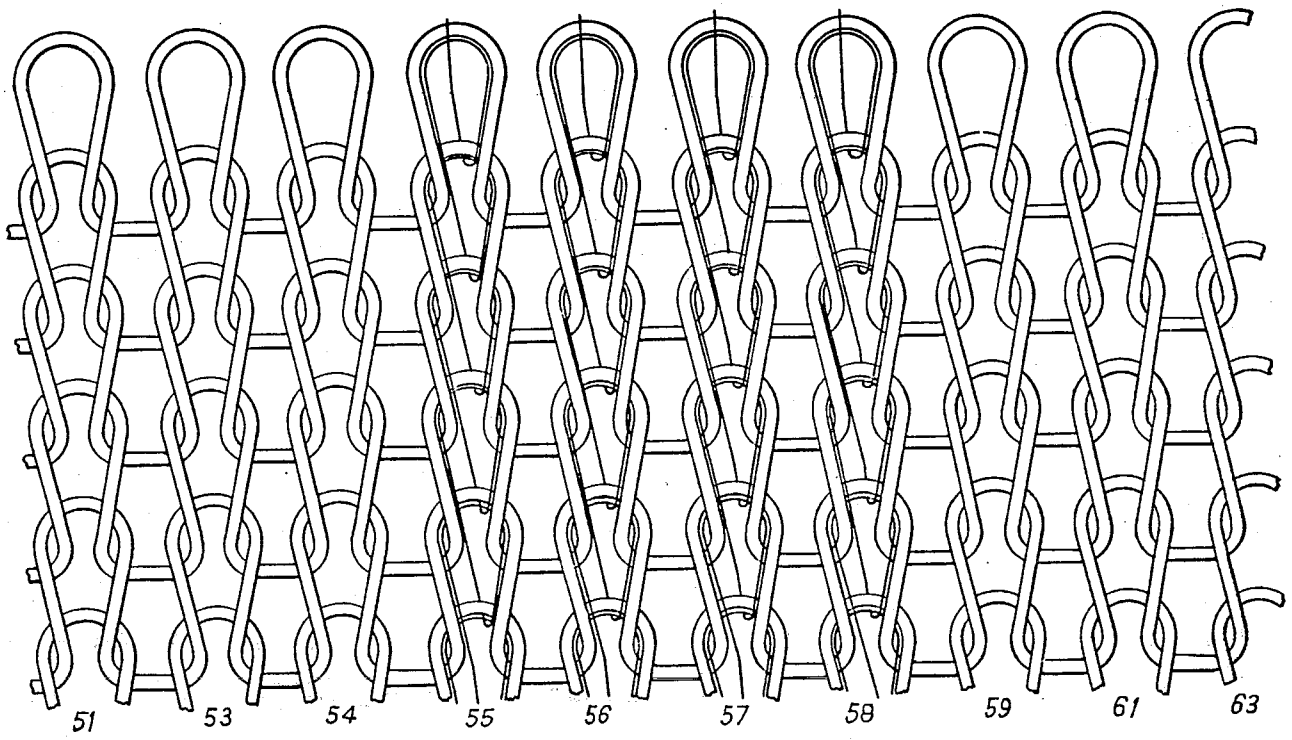
FIGS. 10 to 13 are diagrams of typical fabrics which may be produced on the apparatus of the invention.

In FIG. 10, needle wales 51, 53, 54, 59, 61 and 63 are built up of weft knitted plain loops only, whilst needle wales 55, 56 and 58 are built from weft knitted plain loops overlaid with warp knitted chain stitches or pillar stitches. These warp knitted chain stitches are formed by overlapping and underlapping the yarn guides (shown in FIG. 6) by one needle space.

Figure 11:
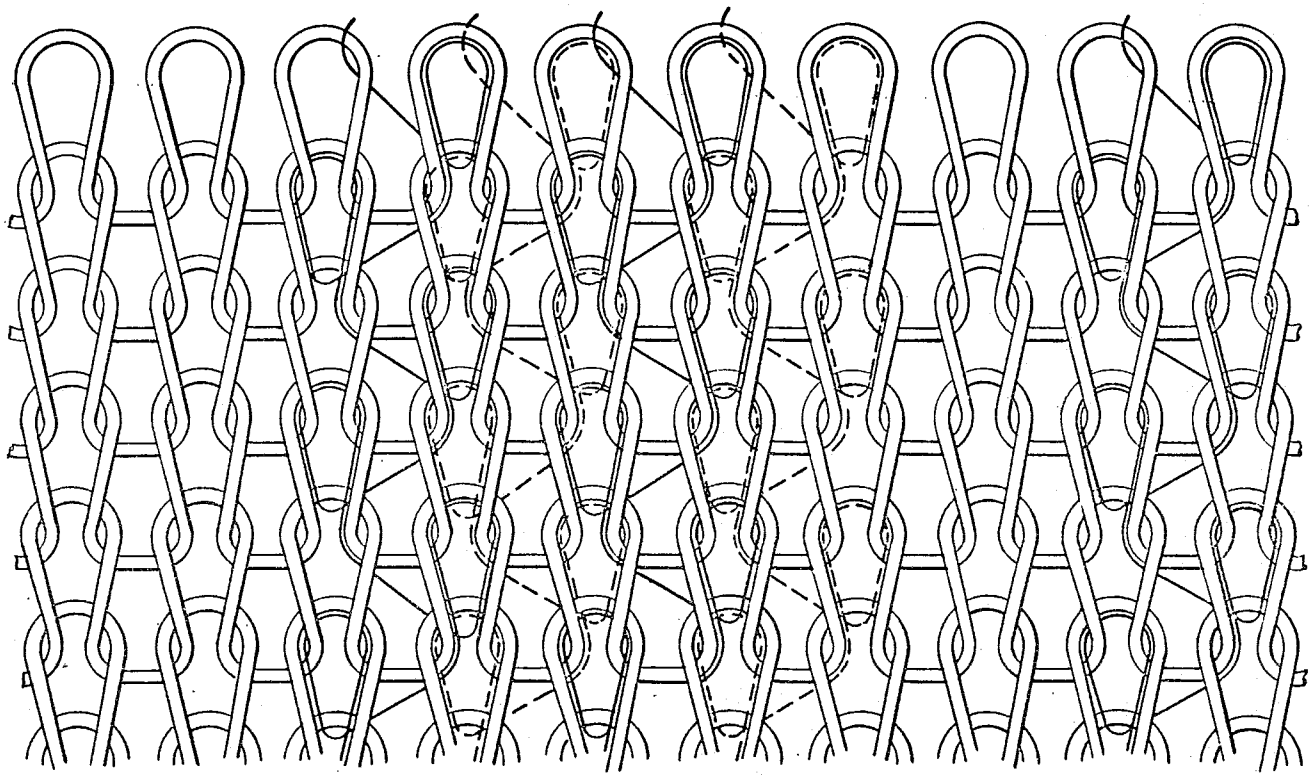
Figure 12:
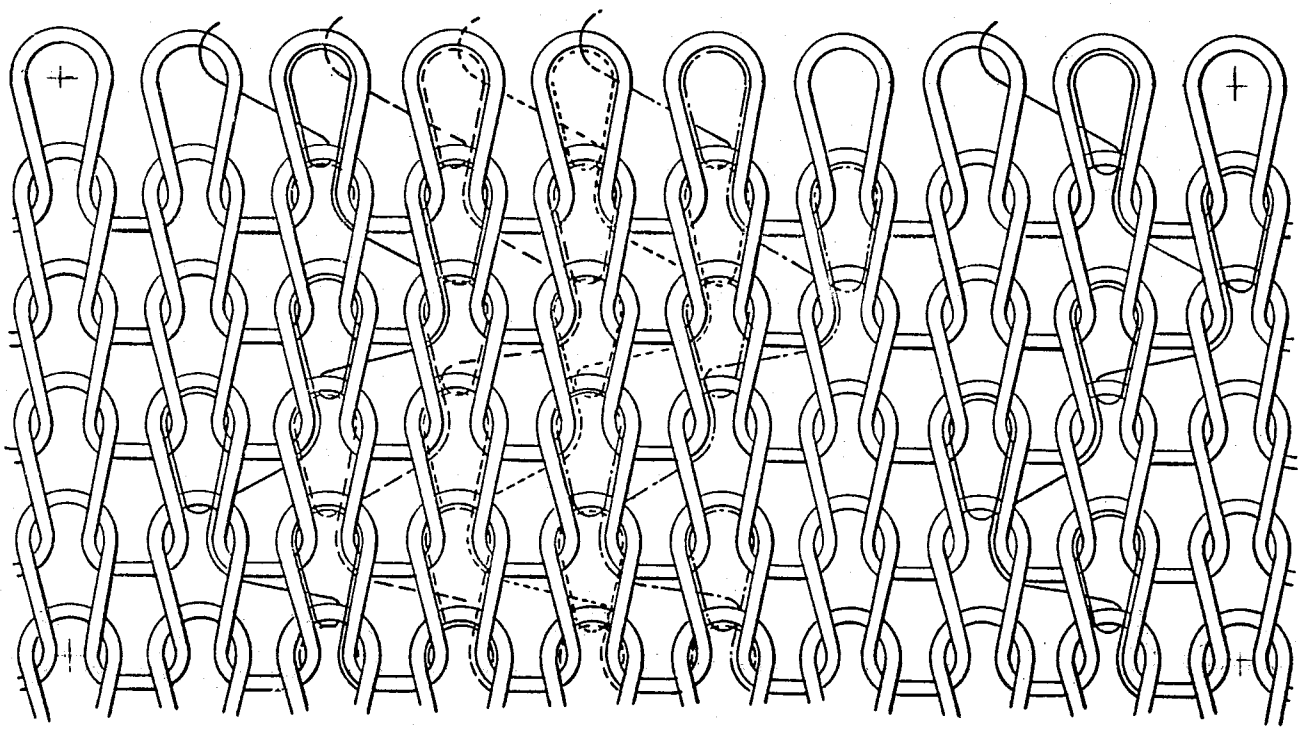

FIGS. 11 and 12 illustrate fabrics similar to that shown in FIG. 10 but the guide bar underlap motions were increased from one needle space to two needle spaces. Moreover, on the fabric shown in FIG. 11, the guide bar underlap and overlap motions change lateral direction with each knitted course. This movement of the guide bars results in warp knitted vertical zig-zag patterns on a plain weft knitted ground fabric. On the other hand, the design effect shown in FIG. 12 is changed by altering the number of knitted courses in relation to the lateral directional change of the yarn guide overlap motions.

Figure 13:
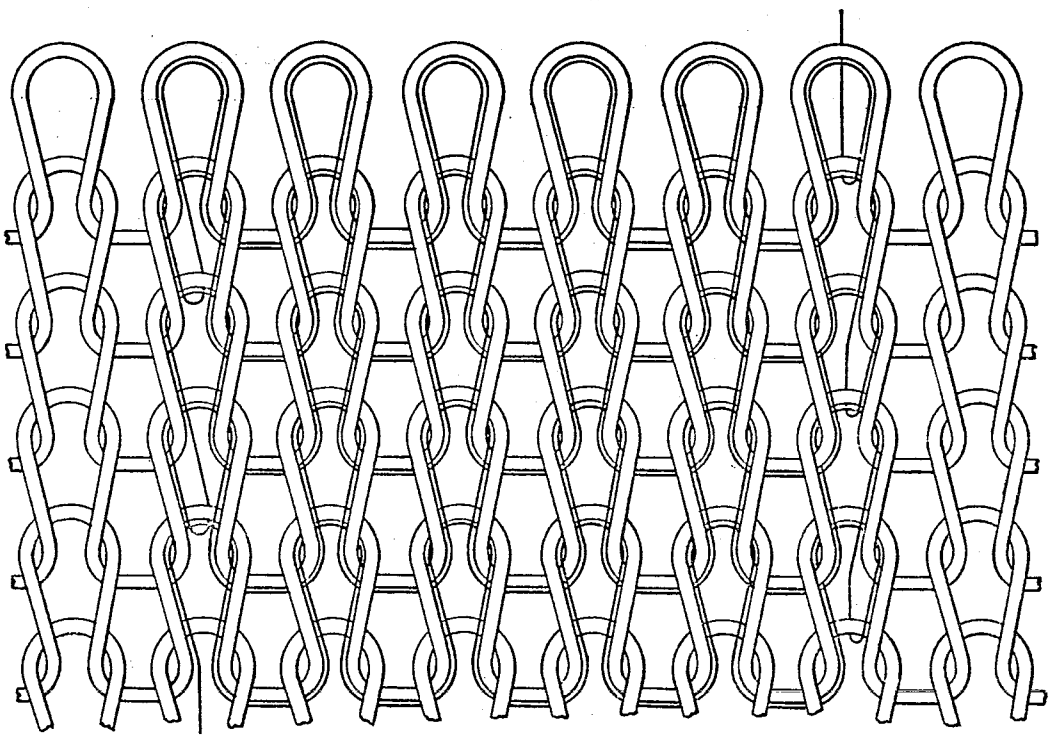

FIG. 13 shows a fabric in the production of which the warp yarn underlap covers more than one needle (in this case six needles) in each course, the direction of underlap being reversed at each course. The result is a block plated effect on the ground weft-knit fabric.

I claim:

1. Apparatus for making a weft-knit fabric comprising a straight bar knitting machine, having a plurality of single beard needles and said knitting machine being provided with conventional lacing bars characterized by associating with the lacing bars auxiliary feeders arranged to feed warp yarn from a supply thereto to selected needles, means for moving said auxiliary feeders backwards during the knitting cycle past the single beard needles and then forward and means for simultaneously racking said auxiliary feeders sideways one or more needle positions, and yarn tensioning means operable in timed relationship with the knitting cycle is adapted to tension the warp yarn so that loops thereof cover the weft loops on the face of the fabric.

2. Apparatus according to claim 1, wherein the warp yarn tensioning means comprises a pair of tensioning bars which can cooperate to retain and/or release a lap of yarn in timed relationship with the knitting cycle.

3. Apparatus according to claim 2, wherein the tensioning bars are movable to hold a lap of warp yarn while it is laid in the selected needles, and to release the lap when the needles descend during the knitting cycle.

4. Apparatus according to claim 1, wherein the warp yarn tensioning means includes a brake fitted to the warp yarn supply which cooperates with the sinkers and needles of the machine to maintain the requisite tension.

* * * * *